US005769656A

United States Patent [19]

Bamburg

[11] Patent Number: 5,769,656

[45] Date of Patent: Jun. 23, 1998

[54] WOUND WIRE TERMINAL ASSEMBLY

[76] Inventor: David C. Bamburg, 325 Albany, Shreveport, La. 71105

[21] Appl. No.: 772,728

[22] Filed: Dec. 23, 1996

Related U.S. Application Data

[63] Continuation-in-part of Ser. No. 743,131, Nov. 1, 1996.

[51] Int. Cl.[6] ..... H01R 4/26

[52] U.S. Cl. ..... 439/431; 439/797; 439/888

[58] Field of Search ..... 439/431, 415, 439/841, 796, 797, 863, 877, 932; 174/94 R, 251, 263; 205/193, 151

[56] References Cited

U.S. PATENT DOCUMENTS

| | | | |
|---|---|---|---|
| 1,300,431 | 4/1919 | Luthy . | |
| 2,731,618 | 1/1956 | Aberle . | |
| 3,048,646 | 8/1962 | England | 136/135 |
| 3,200,190 | 8/1965 | Forney, Jr. | 439/877 |
| 3,267,409 | 8/1966 | Horwitz | 439/877 |
| 3,274,331 | 9/1966 | Quigley | 174/94 R |
| 3,795,890 | 3/1974 | Van Buren . | |
| 3,999,418 | 12/1976 | Morell | 439/863 |
| 4,221,457 | 9/1980 | Allen et al. | 439/841 |
| 4,511,204 | 4/1985 | Glenn . | |
| 4,687,273 | 8/1987 | Pranch | 439/415 |
| 5,013,268 | 5/1991 | Kunz | 439/807 |
| 5,445,907 | 8/1995 | Ito et al. . | |

FOREIGN PATENT DOCUMENTS

| | | | |
|---|---|---|---|
| 112676 | 5/1989 | Japan | 439/888 |

OTHER PUBLICATIONS

"Term–Lok" brochure, Term–Lok Manufacturing Co. (2 pages).

*Primary Examiner*—Gary F. Paumen
*Assistant Examiner*—Brian J. Biggi
*Attorney, Agent, or Firm*—John M. Harrison

[57] ABSTRACT

A wound wire terminal assembly for replacing spade terminals in joining wires, particularly in air conditioning compressor and fan motor relays. The wound wire terminal assembly includes a primary wire connector constructed of wound wire for receiving a male spade terminal connected to a first wire or the first wire itself, and a screw threaded into the primary wire connector and engaging the male spade terminal or the first wire to secure the male spade terminal or first wire in the primary wire connector of the wound wire terminal assembly. The primary wire connector is typically wound on a primary mandrel shaped in the configuration of a cylinder and is connected to a typically smaller, cylindrical, mandrel-wound secondary wire connector that receives a second wire by soldered connection. In a preferred embodiment the wound wire terminal assembly is constructed from a single length of copper wire which is first wound around a primary winding mandrel of selected diameter and subsequently reverse-wound around a secondary winding mandrel of smaller diameter, after which the extending segment or segments of the wire are cut and the assembly is dipped into solder to preserve the structural integrity of the respective coils and enhance conductivity.

20 Claims, 1 Drawing Sheet

WOUND WIRE TERMINAL ASSEMBLY

CROSS-REFERENCE TO RELATED APPLICATIONS

This invention is a continuation-in-part of my copending application Ser. No. 08/743,131 filed Nov. 1, 1996.

BACKGROUND OF THE INVENTION

Field of the Invention

This invention relates to connection assemblies or components for connecting wiring and more particularly, to a wound wire terminal assembly for replacing conventional spade terminal connections in air conditioning, compressor and fan motor relays and other wiring systems. In a most preferred embodiment the wound wire terminal assembly of this invention includes a primary wire connector and a secondary wire connector shaped by winding a single length of wire around a primary mandrel of selected diameter and a secondary mandrel of typically smaller diameter, to create multiple primary and secondary coils. The internal diameters of the respective coils are each sized to effect the desired electrical connection between two wires. The primary wire connector is sized to receive a male spade terminal and terminal post of one wire, or the wire itself, and a threaded keeper, such as a screw, while the secondary wire connector is sized to receive the second wire, typical in a crimped or soldered connection. In a most preferred embodiment the primary wire connector-secondary wire connector combination is dipped in solder to preserve the structural integrity of the respective primary and secondary coils and enhance the electrical conductivity between the connected wiring.

Among the problems which exist in using conventional male and female spade terminals to connect wiring in wiring systems such as air conditioning compressor and fan motor relays and similar applications, is limited space in which to effect a wiring connection and having the terminals burn through after limited service, therefore necessitating frequent replacement of the terminals. In some instances, a device known as a "kerny" is used to extend around the terminal and clamp to the connecting wire. The "kerny" connector is effective and operates to extend the life of the terminal connection, but is very difficult and time-consuming to install, particularly in close or tight places. Other wiring connectors are known in the art. Typical of these is the "Term-Lock" connector characterized by a brass cylinder fitted with stainless steel set screws, wherein the wires to be connected are extended into the cylinder and tightened by means of the set screws. The "Term-Lock" device is manufactured by the Term-Lock Manufacturing Company of Haines City, Fla. U.S. Pat. No. 1,300,431, dated Apr. 15, 1919, to J. O. Luthy, details a "Battery Terminal" having a wedge-shaped fitting for receiving the battery cable and a bolt which connects the battery cable to the battery terminal. Tightening of the bolt expands the wedge-shaped sleeve and tightens the battery cable on the terminal. U.S. Pat. No. 2,731,618, dated Jan. 17, 1956, to U. G. Aberle, details a "Connector" used in terminal junction boxes, where economy of space is important. A cam device engages multiple segments having inner terminal engaging surfaces, such that a nut surrounding the segment may be rotated and the cam device operated to tighten the engaging surfaces together. U.S. Pat. No. 3,795,890, dated Mar. 5, 1974, to Harold Van Buren, Jr. details a "Terminal Connector" characterized by a spring clip fitted with a bolt and having downwardly-extending engaging fingers, such that tightening of the bolt causes the downwardly-engaging fingers to engage the member to which the device is being attached and tightens the fingers on a workpiece. U.S. Pat. No. 4,511,204, dated Apr. 16, 1985, to Robert L. Glenn, details a "Right-Angle Electrical Clamping Connector" having a pair of wedge-shaped members, one of which receives a bolt, such that tightening of the bolt causes the wedge-shaped members to displace with respect to each other and clamp the connector on a workpiece. U.S. Pat. No. 3,048,646, dated Aug. 7, 1962, to H. O. England, details a "Battery Terminal" having a wedge-shaped terminal connector fitted with a screw, such that rotation of the screw engages the battery terminal and the connector to secure the battery terminal on the battery post. U.S. Pat. No. 5,011,268, dated May 7, 1991, to Anton Kunz, details a "Device For Connecting A Heating Wire To A Current Conductor Terminal". The Connecting device is fitted with a shoulder bolt extending vertically therethrough and an opening which receives a ball bearing that communicates with the member or workpiece to be tightened. Rotation of the bolt forces the ball bearing against one piece to be tightened and secures it in the connector. U.S. Pat. No. 5,445,907, dated Aug. 29, 1995, to Ito et al, details a "Battery Terminal" which includes a flange fitted with a bolt and downwardly-extending fingers for engaging the battery terminal, wherein rotation of the bolt causes the fingers to engage the terminal.

It is an object of this invention to provide a new and improved wiring terminal which includes a primary wire connector for receiving at least one first wire or a male spade terminal connected to the wire(s), a threaded fastener for insertion in the primary wire connector and engaging the first wire(s) or male spade terminal for securing the male spade terminal or first wire(s) inside the primary wire connector and a secondary wire connector connected to the primary wire connector for receiving a second wire or wires to be electrically connected to the first wire(s).

Another object of this invention is to provide a new and improved wound wire terminal assembly for connecting wiring, which assembly includes a wound wire primary connector for receiving a first wire or wires in the wiring, or a male spade terminal connected to the first wire(s), a wound wire secondary connector connected to the wound wire primary wire connector for receiving a second wire or wires and a threaded fastener for insertion in the primary wire connector opening and engaging the first wire(s) or the male spade terminal connected to the first wire(s) and the primary wire connector, to secure the first wire(s) or the male spade terminal inside the wound wire primary connector and complete the terminal assembly wiring connection.

Yet another object of this invention is to provide a new and improved wound wire terminal assembly which is constructed from a single length of wire and is therefore characterized by superior electrical conductivity, which terminal assembly includes a primary wound wire connector configured by wrapping a first length of the wire on a primary winding mandrel of selected diameter. A secondary wire connector is created by direct or reverse-wrapping or winding a second length of the wire on a secondary wiring mandrel, typically of lesser diameter than the primary wiring mandrel and the residual end or ends of the wire are then cut to define the wound wire terminal assembly. In a most preferred embodiment the wound wire terminal assembly is dipped into a solder bath to preserve the integrity of the respective coils in the primary wire connector and the secondary wire connector and enhance electrical conductivity between the connectors. The primary wire connector is designed to receive a first or primary wire or a male spade terminal connected to the first wire, while the secondary wire connector receives a second or secondary wire for electrical connection to the primary wire.

SUMMARY OF THE INVENTION

These and other objects of the invention are provided in a new and improved, integral wound wire terminal assembly for connecting primary and secondary wiring, particularly in air conditioner compressor and fan motor relay installations. The assembly is characterized in a preferred embodiment by a primary wire connector created by wrapping a first segment or length of copper wire of selected gauge or size, around a primary winding mandrel of selected diameter to define multiple primary wire coils and direct winding or reverse-winding a second segment or length of the same wire around a secondary winding mandrel, typically, but not necessarily, of lesser selected diameter, to define multiple secondary wire coils. The residual segment or segments of the copper wire may then be cut and the assembly is preferably, but not necessarily, dipped into a liquid solder bath or otherwise coated with solder to preserve the integrity of the coils and increase electrical conductivity through the assembly between the primary and secondary wiring. Alternatively, the wire ends may be trimmed after the assembly is dipped in the solder. The primary wiring, or a male terminal connector such as a male spade terminal connected to the primary wiring, is inserted in the primary wire connector and secured in place by means of a screw. The secondary wiring disposed for connection to the primary wiring, is inserted in the secondary wire connector and soldered, crimped or otherwise secured in place, to complete installation of the wound wire terminal assembly.

BRIEF DESCRIPTION OF THE DRAWING

The invention will be better understood by reference to the accompanying drawing, wherein.

DESCRIPTION OF THE PREFERRED EMBODIMENTS

Figure 1:
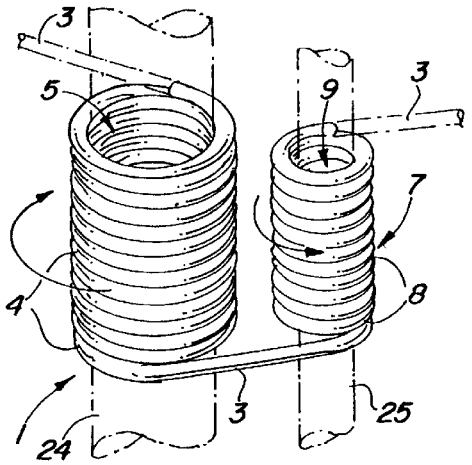
FIG. 1 is a perspective view of a preferred embodiment of the wound wire terminal assembly, more particularly illustrating a preferred method of constructing the assembly.
Figure 2:
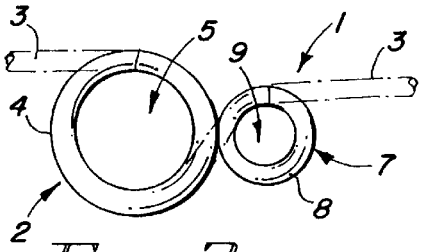
FIG. 2 is a top view of the completed wound wire terminal assembly illustrated in FIG. 1, only reverse-wound.
Figure 4:
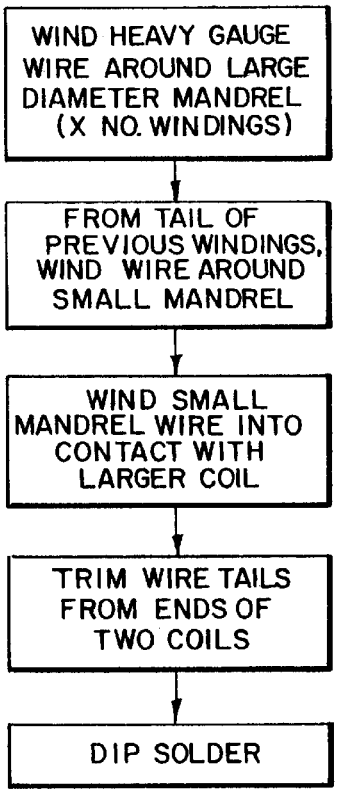
FIG. 4 is a block diagram illustrating a preferred method of constructing the wound wire terminal assembly illustrated in FIGS. 1–3.
Figure 3:
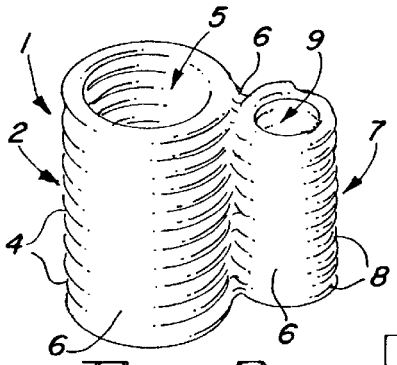
FIG. 3 is a perspective view of the wound wire terminal assembly illustrated in FIGS. 1 and 2 after clipping the extending wire ends and dipping the assembly in solder.

Referring initially to FIGS. 1, 2 and 4 of the drawing, the wound wire terminal assembly of this invention is generally illustrated by reference numeral 1. The wound wire terminal assembly 1 includes a single length of connector wire 3 of desired size or gauge and material, such as copper, initially wound on a primary wounding mandrel 24 of selected diameter (illustrated in phantom) to define a wound wire primary wire connector 2 having primary wire coils 4. This winding procedure is indicated in the first or top box of the block diagram illustrated in FIG. 4. When the desired number of primary wire coils 4 is wound on the primary winding mandrel 24 to create a cylindrial primary wire connector 2 having a primary wire connector bore or opening 5 of desired size, the connector wire 3 is then directly wound around a secondary winding mandrel 25 (illustrated in phantom) of selected size, further illustrated in FIG. 1, to create a cylindrical secondary wire connector 7 having a selected number of secondary wire coils 8, with a secondary wire connector bore or opening 9 of desired size. The primary wire coils 4 and secondary wire coils 8 may also be reverse-wound and are then pressed together, as illustrated in FIG. 2. The steps of constructing the wound wire terminal assembly 1 are detailed in the second and third boxes of the block diagram illustrated in FIG. 4. The projecting unwound end or ends of the connector wire 3 extending from the first one of the primary wire coils 4 and/or the last one of the secondary wire coils 8, are then clipped or trimmed to define a primary wire connector 2 connected to a secondary wire connector 7 by means of the connector wire 3, as further illustrated in phantom in FIG. 2. This step is detailed in box 4 of the block diagram illustrated in FIG. 4. The primary winding mandrel 24 and secondary winding mandrel 25 are then removed from the primary wire coils 4 and secondary wire coils 8, respectively. The wound wire terminal assembly 1 illustrated in FIG. 2 is then dipped into a hot solder bath (not illustrated), as further indicated in the last box of the block diagram illustrated in FIG. 4, to coat both the primary wire connector 2 and the secondary wire connector 7 with solder 6, as illustrated in FIG. 3. Alternatively, the unclipped wound wire terminal assembly illustrated in FIG. 2 can be dipped in the solder bath, using one or both of the extending ends of the connector wire 3 to handle the wound wire terminal assembly 1 and the extending end or ends then clipped.

Figure 7:
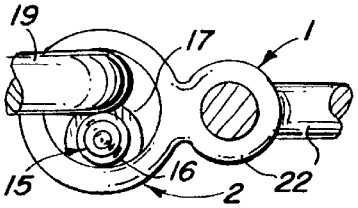
FIG. 7 is a top view of the wound wire terminal assembly illustrated in FIG. 5, more particularly illustrating a single primary wire attached to the primary wire connector by means of a screw and a secondary wire connected to the secondary wire connector of the assembly.
Figure 5:
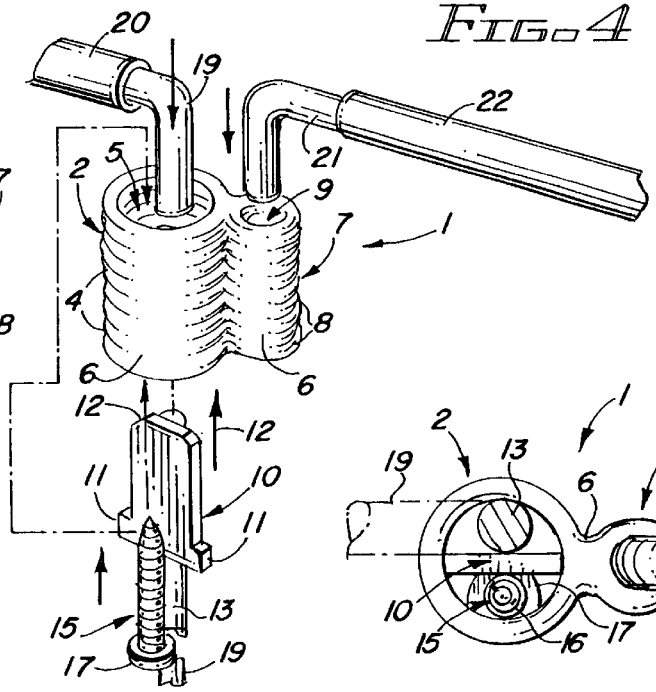
FIG. 5 is an exploded view of the wound wire terminal assembly illustrated in FIG. 3 in functional installation configuration, with the primary wire connector disposed for receiving a screw, along with either a primary wire or a male spade terminal connected to a terminal post and the primary wire, and the secondary wire connector positioned for receiving a secondary wire and electrically connecting the secondary wire to the primary wire.
Figure 6:
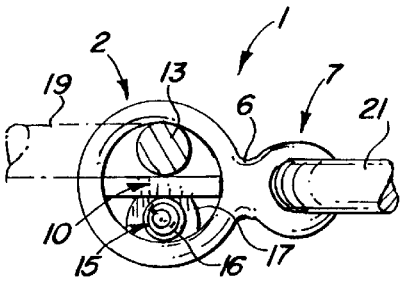
FIG. 6 is a top view of the wound wire terminal assembly illustrated in FIG. 5, more particularly illustrating connection of the male spade terminal to the primary wire connector of the wound wire terminal assembly by means of a screw and a secondary wire soldered, crimped or otherwise attached to the secondary wire connector element of the assembly.

As further illustrated in FIGS. 3 and 5 of the drawing, it will be appreciated that the primary wire connector opening 5 typically receives either a primary wire 19, having primary wire insulation 20, or a conventional male spade terminal 10, connected to the primary wire 19 by means of a terminal post 13, as illustrated in FIG. 5. Accordingly, under circumstances where the primary wire 19 is fitted with a male spade terminal 10, typically having terminal flanges 11 and a terminal bevel 12, the male spade terminal 10 is inserted inside the primary wire connector opening 5 of the primary wire connector 2, as illustrated in FIGS. 5 and 6. Furthermore, a screw 15, having threads 16 and a head 17, is driven by a suitable screwdriver (not illustrated), to secure the male spade terminal 10 inside the primary wire connector opening 5 by tightening the threads 16 of the screw 15 against the male spade terminal 10 and the inside surfaces of the primary wire coils 4 of the primary wire connector 2, as further illustrated in FIG. 6. Moreover, a secondary wire 21 is inserted in either end of the secondary wire connector opening 9 of the secondary wire connector 7 and is typically provided with secondary wiring insulation 22, as further illustrated in FIGS. 5 and 6. It will therefore be appreciated by those skilled in the art that when the screw 15 is threaded into the primary wire connector opening 5 of the primary wire connector 2 with the threads 16 tightly wedged against the male spade terminal 10 and the inside surfaces of the primary wire coils 4, a highly efficient connection between the primary wire 19 and the secondary wire 21 is effected. This electrical connection is greatly enhanced by the integral construction of the wound wire terminal assembly 1, wherein the primary wire connector 2 is connected integrally with the secondary wire connector 7 by the single connector wire 3 and by application of the solder 6. As further illustrated in FIGS. 5 and 7, alternatively, the primary wire 19 may be inserted directly into the primary wire connector opening 5 of the primary wire connector 2 and tightly urged into position by means of the screw 15 in the same manner as illustrated in FIG. 6, but without using the male spade terminal 10. It will therefore be appreciated by those skilled in the art from a consideration of FIGS. 6 and 7, that the wound wire terminal assembly 1 is extremely versatile, in that it may be used to connect either a primary wire 19 of selected gauge or size directly to the primary wire connector 2 and thus, to a secondary wire 21 of selected gauge or size, or the primary wire 19 may be attached to a male spade terminal 10, which in turn, may be inserted in the primary wire connector 2, as heretofore described, for completion of the attachment to the secondary wire 21. Furthermore, both the primary wire connector opening 5 and the secondary wire connector opening 9 can be sized to receive more than one primary wire 19 and/or male spade terminal 10, and secondary wire 21, respectively, as desired, to effect any desired wiring connection.

It will be further appreciated by those skilled in the art that the wound wire terminal assembly of this invention is characterized by ease of installation and disassembly and convenience of repair, since access to the head 17 of the screw 15 is always easily maintained, even in close or tight places and the screw 15 may be quickly and easily removed and inserted in either end of the primary wire connector 2, as illustrated in FIG. 5, to effect assembly and disassembly of the wound wire terminal assembly 1, as described above. Moreover, the single wire construction of the wound wire terminal assembly 1 and the tight connection of the screw 15 inside the primary wire connector opening 5 of the primary wire connector 2, insure that the wound wire terminal assembly 1 is at all times intact and secure and facilitates a ready flow of electricity from the secondary wire 21 through the wound wire terminal assembly 1 and into the primary wire 19 or vice versa, with minimum attrition or "burnout" in the assembly. The efficiency of electrical conductivity in the wound wire terminal assembly 1 is further improved by the solder 6, which fills the gaps and openings between the primary wire coils 4 and secondary wire coils 8, as illustrated in FIGS. 3 and 5. These aspects of the wound wire terminal assembly of this invention insure longevity, less frequence maintenance and less expensive wiring connections. Moreover, it will be appreciated that the primary wire connector opening 5 of the primary wire connector 2 and the secondary wire connector opening 9 of the secondary wire connector 7 may be created in any desired diameter by simply choosing a corresponding primary winding mandrel 24 and secondary winding mandrel 25 of appropriate diameter to accommodate male spade terminal(s) 10 and primary wire or wires 19, as well as a secondary wire or wires 21 of selected gauge and size.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A wound wire terminal assembly for connecting at least one pair of wires, said terminal assembly comprising a length of wound wire defining:

primary connector means having open ends for receiving at least one wire of said at least one pair of wires, and secondary connector means connected to said primary connector means for receiving the other wire of said at least one pair of wires; and engaging means for insertion in one of said open ends of said primary connector means with said at least one wire, whereby said engaging means engages said one wire and said primary connector means and secures said one wire in said primary connector means.

2. The wound wire terminal assembly of claim 1 wherein said primary connector means is configured substantially in the shape of a cylinder.

3. The wound wire terminal assembly of claim 1 wherein said engaging means comprises a threaded fastener.

4. The wound wire terminal assembly of claim 1 wherein:

(a) said primary connector means is configured substantially in the shape of a cylinder; and (b) said engaging means comprises a threaded fastener.

5. The wound wire terminal assembly of claim 1 wherein said primary connector means and said secondary connector means comprise a single length of wire.

6. The wound wire terminal assembly of claim 5 wherein said primary connector means and said secondary connector means are configured substantially in the shape of a cylinder.

7. The wound wire terminal assembly of claim 1 wherein said primary connector means and said secondary connector means are dipped in solder.

8. The terminal assembly of claim 1 wherein:

(a) said primary connector means and said secondary connector means comprise a single length of wire; and (b) said engaging means comprises a threaded fastener.

9. The terminal assembly of claim 8 wherein said primary connector means and said secondary connector means are dipped in solder.

10. A wound wire terminal assembly for connecting a first wire to a second wire, said terminal assembly comprising a wound wire primary connector having a plurality of primary wire coils for receiving the first wire; a wound wire secondary connector having a plurality of secondary wire coils connected to said primary wire coils for receiving the second wire; and a threaded fastener extending into said primary wire coils and engaging the first wire and said primary wire coils for securing the first wire in said wound wire primary connector.

11. The wound wire terminal assembly of claim 10 wherein said threaded fastener comprises a screw.

12. The wound wire terminal assembly of claim 10 wherein a male spade terminal is attached to the first wire, the male spade terminal is inserted in said wound wire primary connector and wherein said threaded fastener engages the male spade terminal and said primary wire coils for securing the male spade terminal and the first wire in said wound wire primary connector.

13. The wound wire terminal assembly of claim 12 wherein said threaded fastener comprises a screw.

14. The wound wire terminal assembly of claim 10 wherein said wound wire primary connector and said wound wire secondary connector comprise a single length of wire.

15. The wound wire terminal assembly of claim 14 wherein said threaded fastener comprises a screw, a male spade terminal is attached to the first wire, the male spade terminal is inserted in said wire coils of said wound wire primary connector and said screw engages the male spade terminal and said primary wire coils for securing the male spade terminal and the first wire in said wound wire primary connector.

16. The wound wire terminal assembly of claim 10 wherein said wound wire primary connector and said wound wire secondary connector are dipped in solder.

17. The wound wire terminal assembly of claim 16 wherein said threaded fastener comprises a screw, a male spade terminal is attached to the first wire, the male spade terminal is inserted in said primary wire coils of said wound wire primary connector and said screw engages the male spade terminal and said primary wire coils for securing the male spade terminal and the first wire in said primary wire coils and said screw engages the male spade terminal and said primary wire coils for securing the male spade terminal and the first wire in said wound wire primary connector.

18. An integral wound wire terminal assembly for connecting a first wire to a second wire, said integral wound wire terminal assembly comprising a length of wire defining a substantially cylindrical wound wire primary connector having wound wire primary coils and at least one open end provided in said wound wire primary coils for receiving the first wire; a substantially cylindrical wound wire secondary connector extending from said wound wire primary connector and having wound wire secondary coils for receiving the second wire; and a threaded fastener extending into said open end of said wound wire primary connector and engaging the first wire and said wound wire primary coils, for securing the first wire in said wound wire primary connector.

19. The wound wire terminal assembly of claim 18 wherein said threaded fastener comprises a screw.

20. The wound wire terminal assembly of claim 19 wherein a male spade terminal is attached to the second wire, the male spade terminal is inserted in said open end of said wound wire primary coils and said screw engages the male spade terminal and said wound wire primary wire coils for securing the male spade terminal and the first wire in said wound wire primary connector.

* * * * *